US006378700B1

(12) United States Patent
Tong

(10) Patent No.: US 6,378,700 B1
(45) Date of Patent: Apr. 30, 2002

(54) TOOL HOLDING AND DISPLAYING DEVICE

(76) Inventor: Hui Lin Tong, No. 108-24, Chong Chin Road, Beu Tun Chu, Taichung (TW), 406

( * ) Notice: Subject to any disclaimer, the term of this patent is extended or adjusted under 35 U.S.C. 154(b) by 0 days.

(21) Appl. No.: 09/676,535

(22) Filed: Sep. 27, 2000

(51) Int. Cl.[7] ..... B65D 85/18
(52) U.S. Cl. ..... 206/376; 206/349
(58) Field of Search ..... 206/349–376, 206/377–477, 495; 211/70.6; 248/309.1

(56) References Cited

U.S. PATENT DOCUMENTS 3,927,765 A * 12/1975 Beal ..... 206/495
5,713,467 A 2/1998 Kao ..... 206/349
5,906,350 A * 5/1999 Kao ..... 206/377
5,996,817 A * 12/1999 Kao ..... 211/70.6
6,164,463 A * 12/2000 Lee ..... 211/70.6
6,193,200 B1 * 2/2001 Kao ..... 248/309.1
6,315,119 B1 * 11/2001 Lee ..... 206/349

* cited by examiner

*Primary Examiner*—David T. Fidei

(57) ABSTRACT

A tool holding and displaying device includes two casings secured to a plate and each having a channel. A frame includes two panels engageable into the channels of the casings. The plate includes one or more catch members for engaging with the frame or with the panels of the frame and for securing or locking the frame to the plate. The frame may be used for receiving the tool and for solidly locking the tool to the plate and for preventing the tool from being easily disengaged from the plate and thus for preventing the tool from being obtained by any unauthorized person.

7 Claims, 3 Drawing Sheets

TOOL HOLDING AND DISPLAYING DEVICE

BACKGROUND OF THE INVENTION

1. Field of the Invention

The present invention relates to a holding device, and more particularly to a tool holding and displaying device.

2. Description of the Prior Art

U.S. Patent No. 5,713,467 to Kao discloses a typical tool holding and displaying device including a catch member having one end pivotally secured to a plate body with a live hinge. The catch member has the other end secured to the plate body with a lock pin of a security device for retaining a tool in the catch member. However, the live hinge for coupling the one end of the catch member to the plate body is weak and may be easily broken by the tool when the tool is twisted relative to the catch member.

The present invention has arisen to mitigate and/or obviate the afore-described disadvantages of the conventional tool holding and displaying devices.

SUMMARY OF THE INVENTION

The primary objective of the present invention is to provide a tool holding and displaying device including a solid and safety structure for solidly and safely retaining the tool in the tool holding and displaying device and for preventing the tool from being easily disengaged from tool holding and displaying device.

In accordance with one aspect of the invention, there is provided a tool holding and displaying device comprising a body including a pair of casings attached thereto and each having a channel formed therein, a frame including two panels engageable into the channels of the casings respectively, and means for locking the frame to the body. The body is provided for holding and displaying a tool therein. The frame is provided for receiving the tool therein and for solidly locking and securing the tool to the body and for preventing the tool from being easily disengaged from the body.

The casings each includes a bottom wall at and an outer wall secured to the body for defining the channel of the casings respectively.

The frame includes at least one groove formed therein, the body includes at least one rib extended therefrom and engaged into the groove of the frame. The rib of the body is extended from a first of the casings.

The locking means includes at least one catch member provided in the body and engageable with the frame for securing and locking the frame to the body. The body includes at least one orifice formed therein, the catch member is extended in the orifice of the body. The catch members may be broken or cut from the orifices of the body for releasing the frame and for allowing the frame end thus the tool to be easily disengaged from the body.

The frame includes at least one cavity formed therein, the catch member is engaged into the cavity of the frame for securing the frame to the body. The cavity of the frame is formed in a first of the panels of the frame. It is preferably that the frame includes two or more cavities formed therein for receiving the corresponding catch members of the body and for solidly securing the frame to the body.

Further objectives and advantages of the present invention will become apparent from a careful reading of a detailed description provided hereinbelow, with the appropriate reference to accompanying drawings.

DETAILED DESCRIPTION OF THE PREFERRED EMBODIMENT

Figure 2:
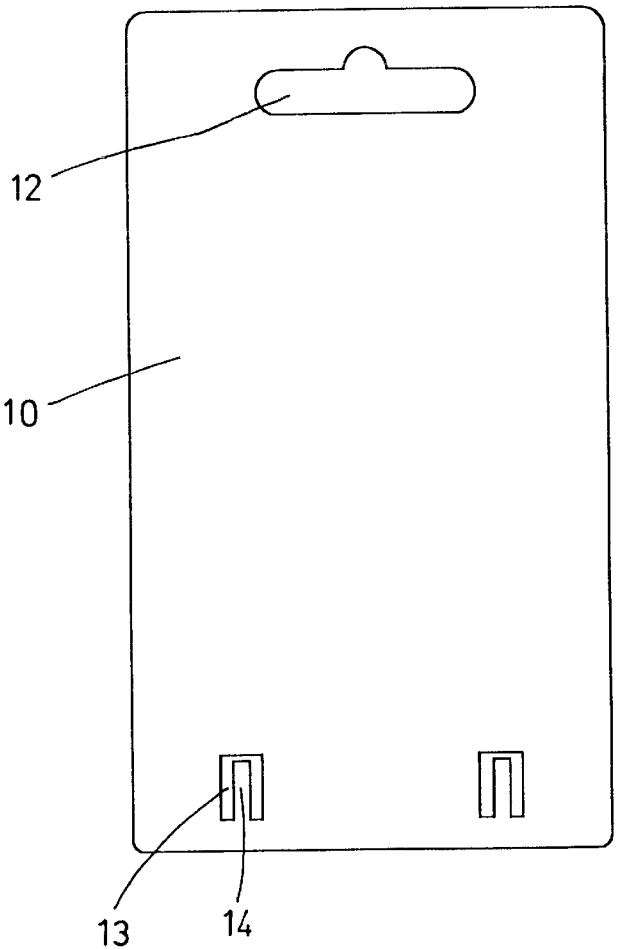
FIG. 2 is a rear elevational view of the tool holding and displaying device.
Figure 1:
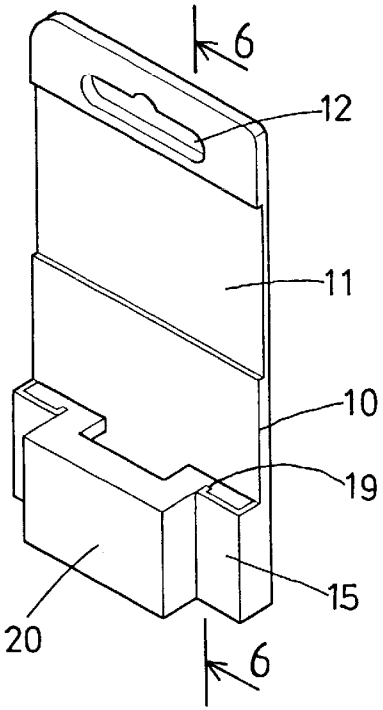
FIG. 1 is a perspective view of a tool holding and displaying device in accordance with the present invention.
Figure 4:
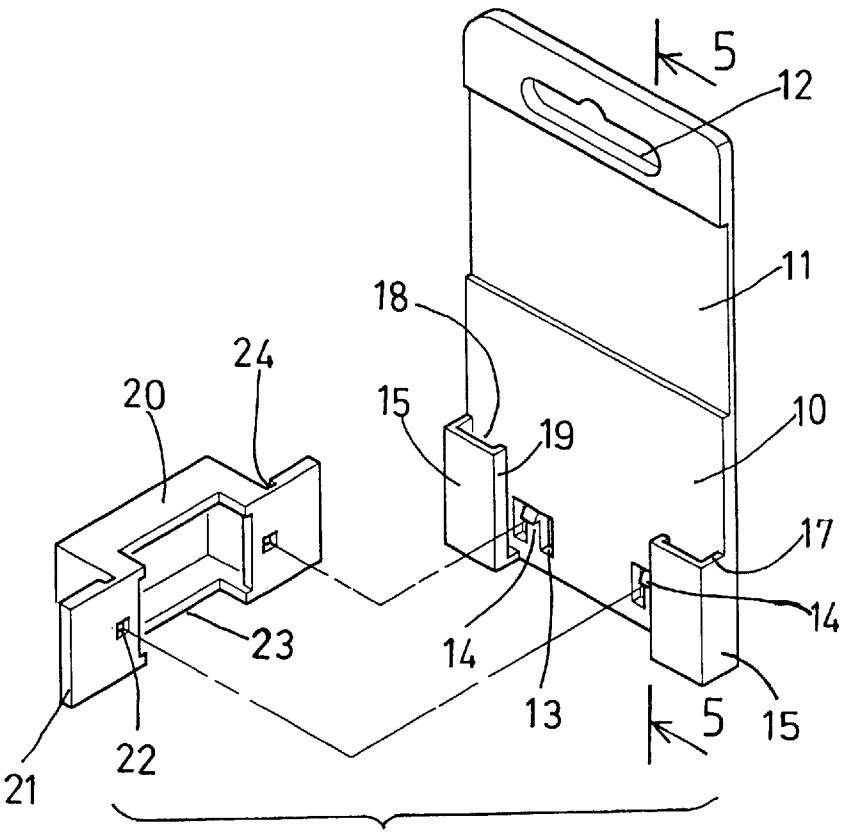
FIG. 4 is an exploded view of the tool holding and displaying device, in which the frame of the tool holding and displaying device is seen from the upper and rear portion thereof.
Figure 3:
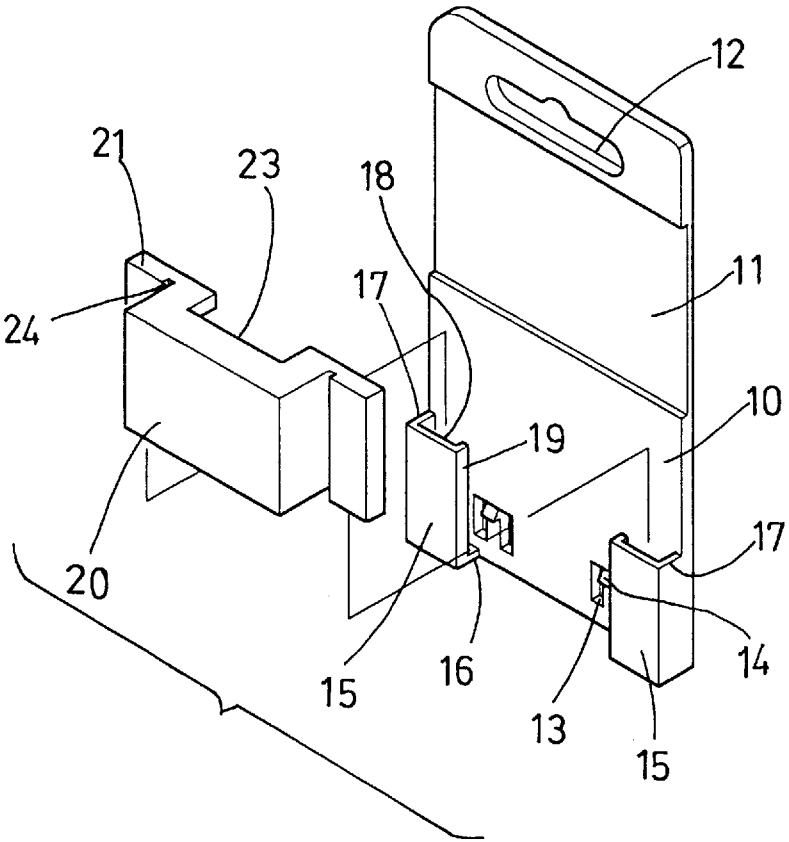
FIG. 3 is an exploded view of the tool holding and displaying device, in which the frame of the tool holding and displaying device is seen from the upper and front portion thereof.

Referring to the drawings, and initially to FIGS. 1–6, a tool holding and displaying device in accordance with the present invention comprises a body 10, such as a plate or a board, including a recess 11 formed in the middle portion thereof for attaching or for applying with an advertising or an instruction or a manual for the tool received in the tool holding and displaying device. The body 10 includes an opening 12 formed in the upper portion for hanging purposes, and includes a lower portion having one or more orifices 13 formed therein, and having one or more hooks or catches 14 extended inward of the orifices 13 of the body 10 respectively.

The body 10 includes a pair of casings 15 attached to the front and lower portion thereof and separated from each other. The casings 15 each includes a bottom wall 16 and an outer wall 17 for defining a channel 18 therein and each includes an inner portion having a rib 19 extended inward of the channel 18 thereof. A frame 20 includes a pair of side panels 21 engageable into the channels 18 of the casings 15 from the upper portion of the casings 15, and includes one or more cavities 22 formed therein, such as formed in the panels 21 for receiving the catches 14 (FIG. 6) which may secure and lock the frame 20 to the body 10 and which may prevent the frame 20 from being disengaged from the body 10. The frame 20 includes one or more chambers 23 formed therein for receiving a tool member 70. The frame 20 includes one or more grooves 24 formed therein for receiving the ribs 19 of the body 10 and for further stably securing the frame 20 to the body 10.

Figure 7:
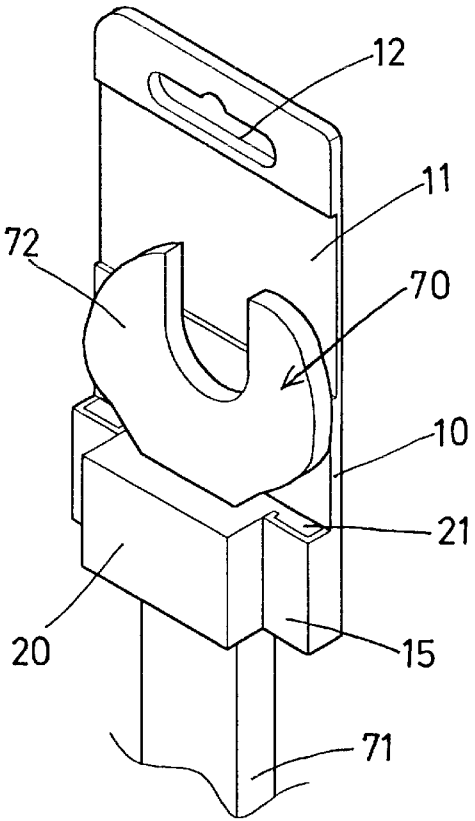
FIG. 7 is a partial perspective view illustrating the operation of the tool holding and displaying device.
Figure 6:
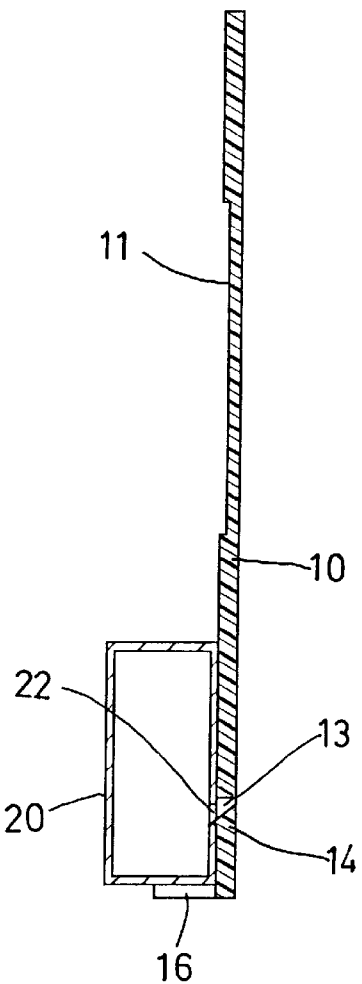
FIGS. 5 and 6 are cross sectional views taken along lines 5—5 and 6—6 FIGS. 4 and 1 respectively.
Figure 5:
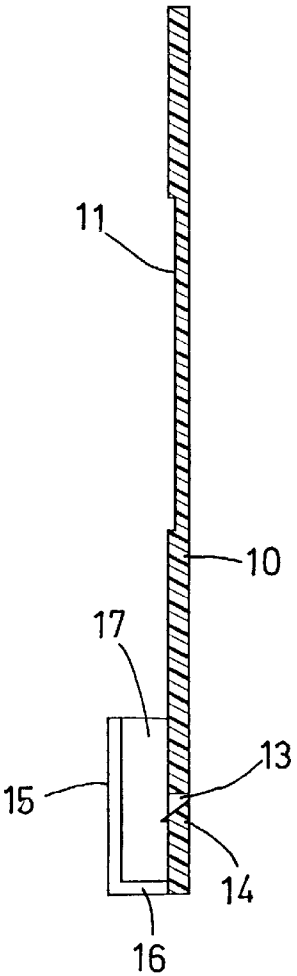

In operation, as shown in FIG. 7, the tool 70, particularly the handle 71 or the relatively smaller portion of the tool 70 may be received in the chamber 23 of the frame 20. Normally, the tool 70 includes two heads 72 having a size or a diameter greater than the handle 71 thereof such that the tool 70 may not be disengaged from the frame 20 when the frame 20 is locked to the body 10. The tool 70 may thus be held and displayed in the body 10 and may be prevented from being easily disengaged from the body 10 by any unauthorized person. After displaying or after use, the user may cut or break the catches 14 in order to release the frame 20 and for allowing the frame 20 and thus the tool 70 to be disengaged from the body 10.

Accordingly, the tool holding and displaying device in accordance with the present invention includes a solid and safety structure for solidly and safely retaining the tool in the tool holding and displaying device and for preventing the tool from being easily disengaged from the tool holding and displaying device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool holding and displaying device comprising:

a body including a pair of casings attached thereto and each having a channel formed therein, said casings each including a bottom wall and an outer wall secured to said body for defining said channel of said casings respectively, a frame including two panels engageable into said channels of said casings respectively, and means for locking said frame to said body, said bottom wall and said outer wall of said casings being provided for supporting said panels of said frame in said casings respectively without said locking means.

2. The tool holding and displaying device according to claim 1, wherein said frame includes at least one groove formed therein, said body includes at least one rib extended therefrom and engaged into said at least one groove of said frame.

3. The tool holding and displaying device according to claim 2, wherein said at least one rib of said body is extended from a first of said casings.

4. The tool holding and displaying device according to claim 1, wherein said locking means includes at least one catch member provided in said body and engageable with said frame for securing ad locking said frame to said body.

5. The tool holding and displaying device according to claim 4, wherein said body includes at least one orifice formed therein, said at least one catch member is extended in said at least one orifice of said body.

6. The tool holding and displaying device according to claim 4, wherein said frame includes at least one cavity formed therein, said at least one cavity of said frame for securing said frame to said body.

7. The tool holding and displaying device according to claim 6, wherein said at least one cavity of said frame is formed in a first of said panels of said frame.

* * * * *